US008348715B2

(12) United States Patent
Miyake

(10) Patent No.: US 8,348,715 B2
(45) Date of Patent: Jan. 8, 2013

(54) TRANSFORMABLE TOY

(75) Inventor: Tomoya Miyake, Tokyo (JP)

(73) Assignee: Tomy Company, Ltd., Tokyo (JP)

( * ) Notice: Subject to any disclaimer, the term of this patent is extended or adjusted under 35 U.S.C. 154(b) by 195 days.

(21) Appl. No.: 12/801,375

(22) Filed: Jun. 4, 2010

(65) Prior Publication Data

US 2011/0111672 A1 May 12, 2011

(30) Foreign Application Priority Data

Nov. 12, 2009 (JP) ..... 2009-281289

(51) Int. Cl.
*A63H 17/02* (2006.01)
*A63H 17/00* (2006.01)

(52) U.S. Cl. ..... 446/95; 446/321

(58) Field of Classification Search ..... 446/4, 6, 446/321, 431, 465, 470, 471, 487, 94–96, 446/466

See application file for complete search history.

(56) References Cited

U.S. PATENT DOCUMENTS 4,170,840 A * 10/1979 Ogawa ..... 446/95
4,206,564 A 6/1980 Ogawa
4,214,402 A 7/1980 Ogawa
4,302,903 A 12/1981 Pun
4,391,060 A 7/1983 Nakane
4,516,948 A 5/1985 Obara
D279,307 S 6/1985 Murakami
4,543,073 A * 9/1985 Matsuda ..... 446/230
4,545,451 A 10/1985 Pipa et al.
4,571,201 A 2/1986 Matsuda
4,571,203 A * 2/1986 Murakami ..... 446/95
4,575,352 A 3/1986 Matsuda
4,578,046 A * 3/1986 Ohno ..... 446/376
4,580,993 A 4/1986 Ohno
4,583,958 A 4/1986 Matsuda
4,586,911 A 5/1986 Murakami
4,599,078 A 7/1986 Obara
4,605,383 A 8/1986 Horiuchi (Continued)

FOREIGN PATENT DOCUMENTS

CN 1909948 A 2/2007

(Continued)

OTHER PUBLICATIONS

English Abstract of FR 2864793, published Jul. 8, 2005.

(Continued)

*Primary Examiner* — Kien Nguyen
(74) *Attorney, Agent, or Firm* — Staas & Halsey LLP

(57) ABSTRACT

A transformable toy which is transformed without any direct touching by a user, displays visual information that is invisible before the form of the toy is changed, and has a game element in addition to the form change is provided. A transformable toy reversibly transformed between a first form and a second form includes a toy main body which changes its form to form the first form and the second form, a restricting mechanism which restricts the form change of the toy main body, and a transformation activating body for detecting physical stimulation from outside and releasing the restriction by the restricting mechanism. The toy main body includes a display body having visual information thereon, and the display body is disposed at such a position that the visual information of the display body is invisible to a user in the first form while the visual information of the display body is visible to the user in the second form.

35 Claims, 7 Drawing Sheets

U.S. PATENT DOCUMENTS

| | | | | |
|---|---|---|---|---|
| 4,623,317 | A | 11/1986 | Nagano | |
| D287,258 | S | 12/1986 | Maruyama | |
| 4,674,990 | A * | 6/1987 | Ohno | 446/376 |
| 4,680,018 | A * | 7/1987 | Ohno | 446/376 |
| D291,461 | S | 8/1987 | Kitamura | |
| D292,109 | S | 9/1987 | Lim | |
| D293,805 | S | 1/1988 | Matsumoto | |
| 4,750,895 | A | 6/1988 | Shinohara et al. | |
| 5,310,378 | A | 5/1994 | Shannon | |
| 5,449,174 | A | 9/1995 | Criner | |
| 5,586,911 | A * | 12/1996 | Miller et al. | 439/607.28 |
| 7,568,965 | B2 | 8/2009 | Toriyama et al. | |
| 7,785,168 | B2 | 8/2010 | Yamada et al. | |
| 8,066,542 | B2 * | 11/2011 | Ejima | 446/93 |
| 2009/0209167 | A1 | 8/2009 | Ejima | |
| 2009/0209168 | A1 | 8/2009 | Ejima | |
| 2009/0227175 | A1 | 9/2009 | Hasui | |
| 2009/0233519 | A1 | 9/2009 | Ejima | |

FOREIGN PATENT DOCUMENTS

| | | | |
|---|---|---|---|
| CN | 101507877 | A | 8/2009 |
| CN | 101530669 | A | 9/2009 |
| FR | 2864793 | | 7/2005 |
| GB | 25254 | | 0/1911 |
| GB | 2151149 | | 7/1985 |
| JP | 62-72689 | | 5/1987 |
| JP | 7-17555 | | 3/1995 |
| JP | 7-250972 | | 10/1995 |
| JP | 9-10442 | | 1/1997 |
| JP | 9-28933 | | 2/1997 |
| JP | 3068216 | | 2/2000 |
| JP | 3913746 | | 5/2007 |
| WO | 99/07619 | | 2/1999 |

OTHER PUBLICATIONS

European Communication and Search Report dated Apr. 26, 2011 in Application No. 10250973.4.

Hong Kong Search Report issued Sep. 10, 2010 in corresponding Hong Kong Patent Application 10107601.4.

English Translation of the Hong Kong Search Report issued Sep. 10, 2010 in corresponding Hong Kong Patent Application 10107601.4.

Partial English Translation of JP 62-72689, publication date May 9, 1987.

Abstract for Japanese publication No. 7-250972, publication date Oct. 3, 1995.

Partial English Translation of JP 7-17555, publication dated Mar. 28, 1995.

Japanese Patent Abstracts, Publication No. 3068216, Published Apr. 28, 2000.

Japanese Patent Abstracts, Publication No. 3913746, Published May 9, 2007.

Patent Abstracts of Japan, Publication No. 9-10442, Published Jan. 14, 1997.

Patent Abstracts of Japan, Publication No. 9-28933, Published Feb. 4, 1997.

U.S. Office Action dated Oct. 28, 2010 in U.S. Appl. No. 12/379,117, now U.S. Patent No. 8,066,542.

U.S. Office Action dated Jun. 28, 2011 in U.S. Appl. No. 12/379,117, now U.S. Patent No. 8,066,542.

Notice of Allowance dated Sep. 7, 2011 in U.S. Appl. No. 12/379,117, now U.S. Patent No. 8,066,542.

European Search Report in Application No. 092507326 dated Jul. 3, 2009.

* cited by examiner

TRANSFORMABLE TOY

CROSS REFERENCE TO RELATED APPLICATION

This application claims the benefit of Japanese Application No. 2009-281289, filed Dec. 11, 2009, the disclosure of which is incorporated herein by reference.

BACKGROUND OF THE INVENTION

1. Field of the Invention

The present invention relates to a transformable toy, and more particularly to a transformable toy that can carry out displaying visual information, in addition to form change, when the toy is transformed from one form to another form.

2. Description of the Related Art

Conventionally, various transformable toys that can be transformed from one form to another form have been proposed (for example, Japanese Utility Model Application Laid-Open Publication No. 62-72689). The toy disclosed in Japanese Utility Model Application Laid-Open Publication No. 62-72689 is so constructed that, when the toy in one form or a running toy hits an obstacle, the toy is automatically transformed into another form or a robot toy without any touching by a user.

Unlike most transformable toys that are each transformed from a running toy to a robot toy by operating constituent members thereof one by one, the above described transformable toy gives a surprise that the form thereof is automatically changed when the toy hits an obstacle and also gives amusement in that the form thereof is instantaneously changed from the running toy to the robot toy. However, after the form of the toy has been changed, the toy is no different from normal transformable toys. That is, there has been a problem in that it lacks a game element.

SUMMARY OF THE INVENTION

The present invention has been made in order to solve the above described problem. It is an object of the present invention to provide a novel transformable toy that not only can be transformed but also has a game element, wherein the transformable toy is transformed without any direct touching by the user and displays visual information which is invisible before the form is changed, to thereby enable a game to be played by utilizing the visual information.

In order to solve the above described problem, according to the present invention, there is provided a transformable toy reversibly transformed between a first form and a second form. The transformable toy includes: a toy main body which changes a form to form the first form and the second form; a restricting mechanism which restricts the form change of the toy main body from the first form to the second form; and a transformation activating body for detecting physical stimulation from outside and releasing the restriction by the restricting mechanism; wherein the toy main body includes a display body having visual information thereon, and the display body is disposed at such a position that the visual information of the display body is invisible to a user in the first form while the visual information of the display body is visible to the user in the second form.

According to one embodiment of the present invention, the transformation activating body is supported to slide back and forth by the toy main body in the first form; the toy main body includes a body portion for supporting the transformation activating body and a base body for supporting the body portion to be turnable in a vertical direction, and when the body portion is turned downward, the toy main body forms the first form of the transformable toy; when the transformation activating body slides backward, the restriction by the restricting mechanism is released, the body portion turns upward relative to the base body and becomes in an upright state with respect to the base body, so that the toy main body forms the second form of the transformable toy; and when the body portion turns upward, the display body is positioned in a front surface of the toy main body which can be seen by looking down upon it.

According to one embodiment of the present invention, the display body is formed to have a drum shape and has a plurality of pieces of visual information provided on a circumferential surface of the display body along a circumferential direction; and the display body is disposed in the toy main body so that, in the first form, the display body is rotatable in a front-back direction while the circumferential surface of the display body is in contact with a supporting surface, on which the transformable toy is placed, and so that, in the second form, one of the plurality of pieces of the visual information on the circumferential surface of the display body is visible.

According to one embodiment of the present invention, the base body includes an engaging portion that is disengageably engaged with the display body to prevent rotation of the display body in the second form, so that when the engaging portion of the base body is engaged with the display body, the one piece of visual information is made visible.

According to one embodiment of the present invention, the circumferential surface of the display body is divided into a plurality of areas in the circumferential direction, each of the areas having a respective one of the plurality pieces of visual information; and the display body includes a polygonal engaging plate that has a number of sides corresponding to the number of the plurality of areas and that is provided on a side surface of the display body, so that the engaging portion of the base body is engaged with one of the sides of the engaging plate to prevent rotation of the display body and specify the one piece of visual information to be made visible.

According to one embodiment of the present invention, the restricting mechanism includes an engaging projection formed on the base body, a latch releasing member on which a hook engageable with the engaging projection of the base body is formed and which is coupled with the transformation activating body, and a spring for biasing the latch releasing member to engage the hook of the latch releasing member with the engaging projection of the base body; and when the transformation activating body slides backward, the hook of the latch releasing member is disengaged from the engaging projection of the base body so as to release the restriction by the restricting mechanism.

According to one embodiment of the present invention, the transformable toy is a running toy in the first form and is a robot toy in the second form.

According to one embodiment of the present invention, the transformable toy is a running toy in the first form and is a robot toy in the second form; the transformation activating body and the toy main body form a hood and a body of the running toy, respectively, in the first form; the latch releasing member and the transformation activating body are coupled with each other and biased by another spring so that the transformation activating body turns upward relative to the latch releasing member; the body portion includes a head portion formed thereon, the head portion having a latching member engageable with the transformation activating body; in the first form, the latching member is engaged with the transformation activating body, the head portion being positioned in the transformation activating body; and when the transformation activating body is disengaged from the latching member of the head portion, the transformation activating body turns upward due to it being biased by the other spring, so that the head portion is exposed to constitute a head of the robot toy in the second form.

According to one embodiment of the present invention, the toy main body includes a cover member that constitutes a cab in the first form and a pair of side covers having rear wheels, each of the side covers being supported to be turnable in a lateral direction at a front end thereof by the cover member and being detachably fixed to the base body at a rear end thereof; and in the robot toy of the second form, the base body forms leg portions of the robot toy, and the pair of side covers constitute arm portions of the robot toy with the rear ends thereof being detached from the base body.

According to the present invention, when the transformable toy receives physical stimulation from outside and changes the form thereof from a first form to a second form, the display body provided in the toy main body appears so that visual information can be provided to a user, and a game can be played by utilizing the visual information. Therefore, a new concept transformable toy having a game element which cannot be obtained by the conventional transformable toys that merely change their form can be provided.

According to one embodiment of the present invention, the transformable toy can be realized in which, when the transformation activating body is caused to slide backward by the physical stimulation, the restriction by the restricting mechanism is released, and the body portion turns upward relative to the base body and becomes in an upright state, thereby changing the form to the second form and bringing the display body into the state where the display body can be seen by looking down upon it.

According to one embodiment of the present invention, the display body is formed to have a drum shape and is rotated while in contact with a supporting surface in the first form, whereas one piece of visual information corresponding to the position at which the display body is stopped is seen in the second form, so that various pieces of information that cannot be obtained by the fixed information displayed on a plate or the like can be seen.

According to one embodiment of the present invention, the display body is so constructed that it cannot be rotated when the form of the transformable toy is changed to the second form. Therefore, the transformable toy equipped with a game element in which win/loss can be judged based on the visual information of the display body of one transformable toy and that of another transformable toy of an opponent can be realized.

According to one embodiment of the present invention, when the transformable toy is in the form of a running toy, the display body rotates while in contact with a supporting surface on which the transformable toy runs. When the transformable toy is caused to run directly towards the opponent's transformable toy, hit it and is transformed into the form of a robot toy, the rotation of the display body is stopped and one piece of the visual information can be specified. Therefore, a battle game between the transformable toys or robot toys can be enjoyed.

DESCRIPTION OF THE PREFERRED EMBODIMENT

Figure 1B:
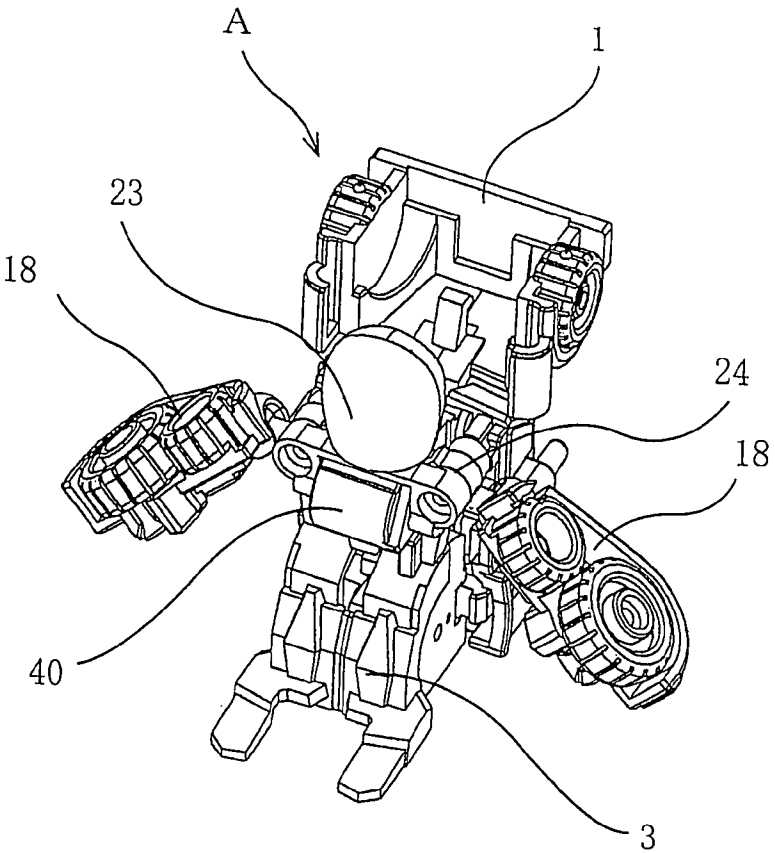
FIGS. 1A and 1B are perspective views showing a first form and a second form of an embodiment of a transformable toy according to the present invention, respectively.
Figure 1A:
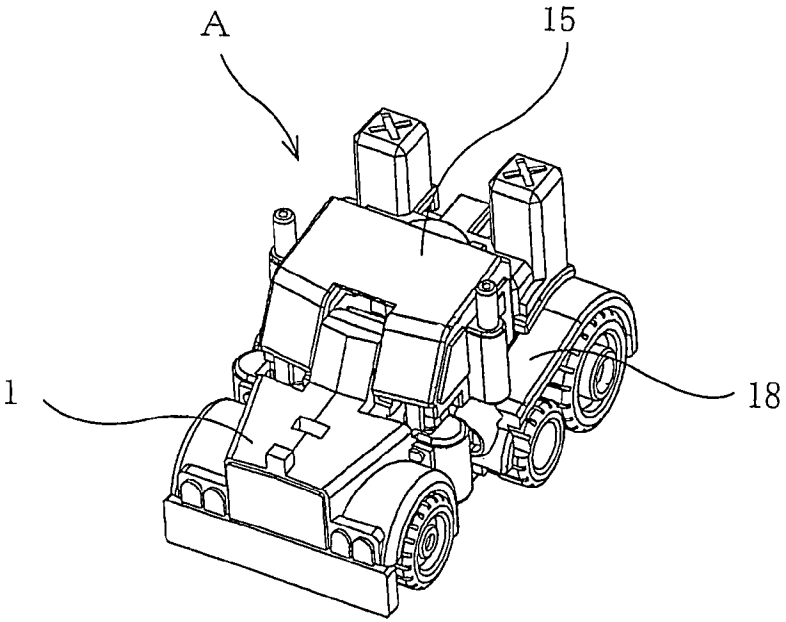

FIGS. 1A and 1B show an embodiment of a transformable toy A according to the present invention. The transformable toy A is so constructed that the transformable toy A has the form of a running toy, which is one form or a first form, as shown in FIG. 1A, and when the toy A senses a physical stimulus by hitting an obstacle such as another transformable toy or a wall, the form thereof is changed to that of a robot toy, which is another form or a second form, as shown in FIG. 1B.

Figure 2:
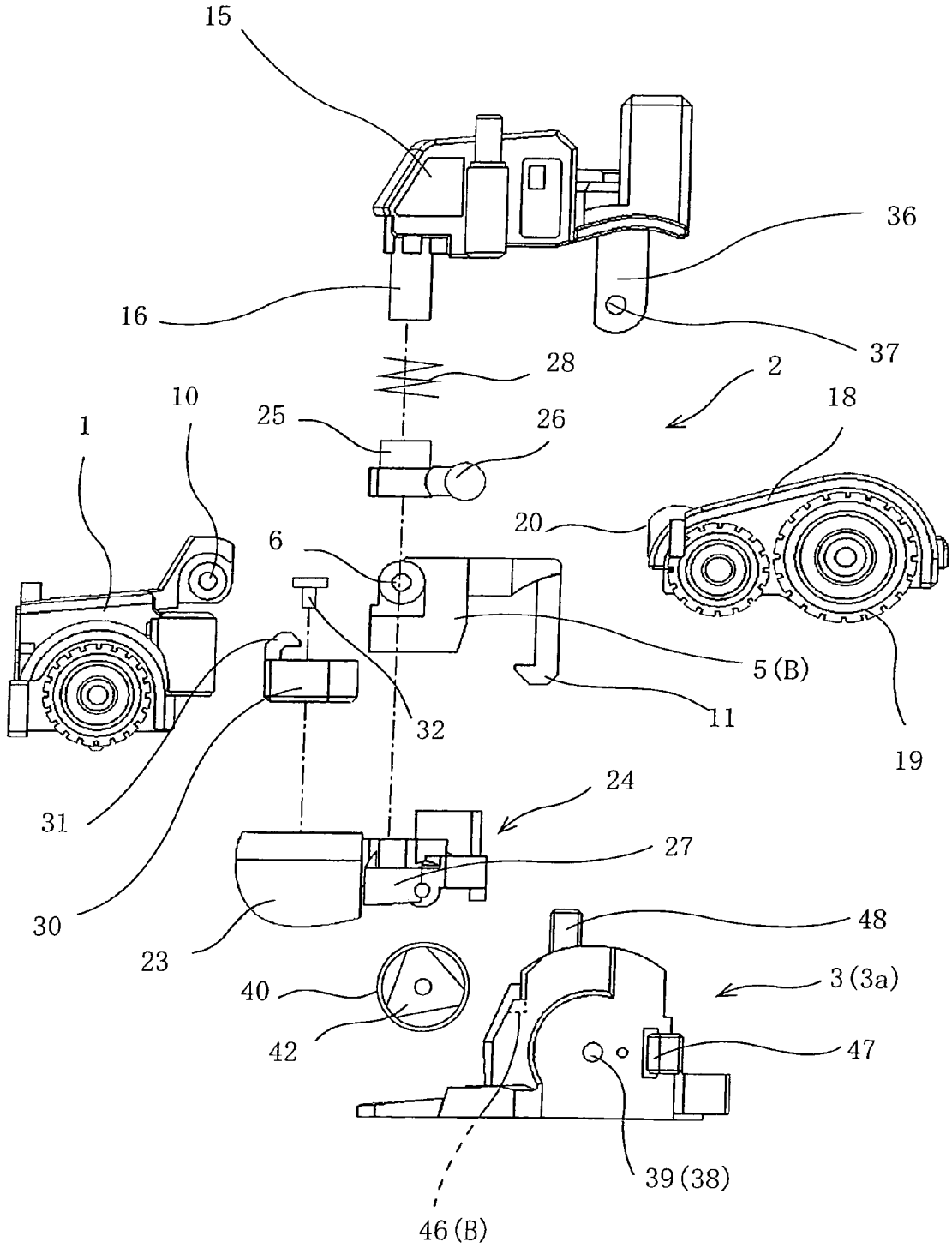
FIG. 2 is an exploded side view showing construction of the transformable toy.
Figure 3:
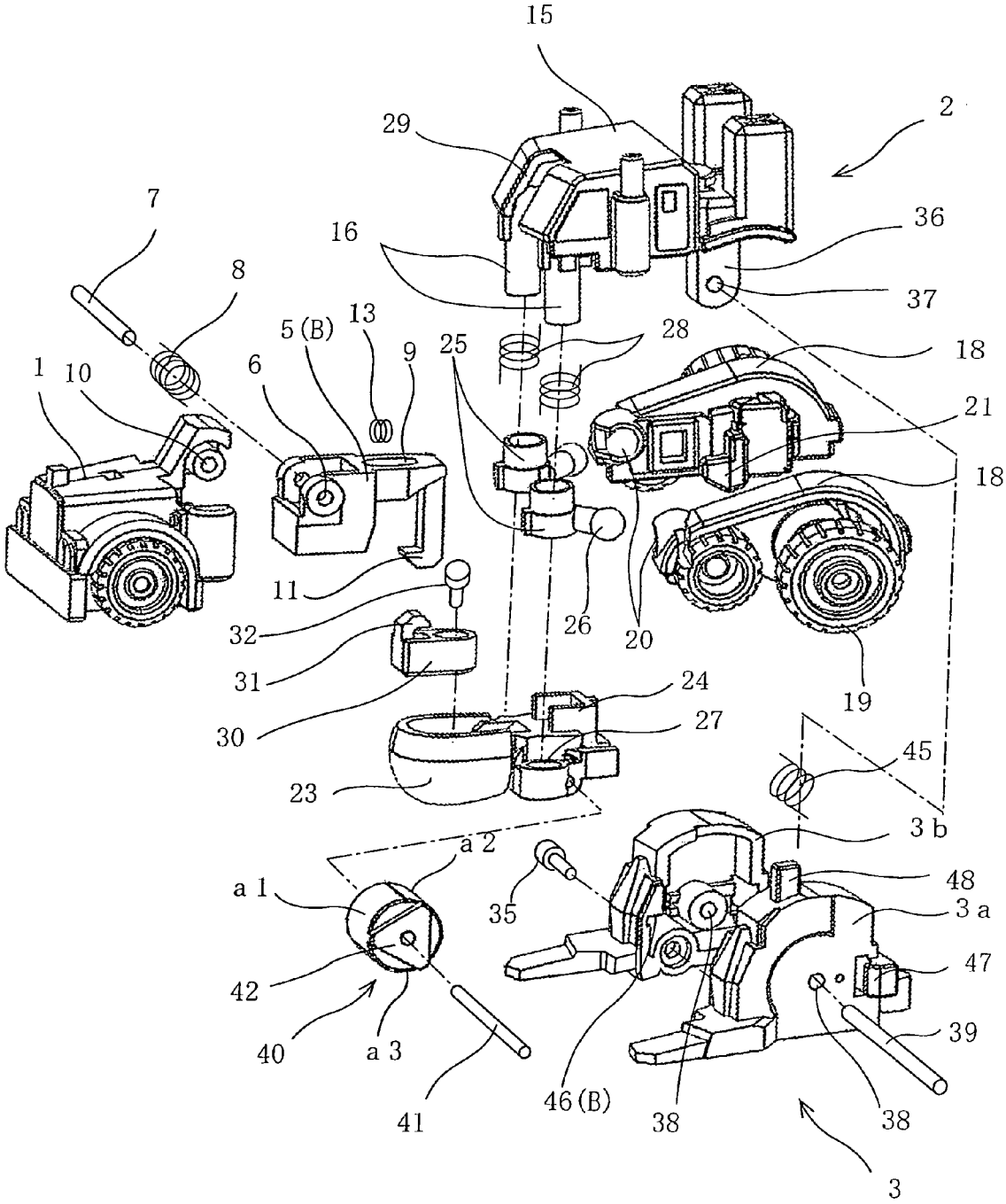
FIG. 3 is an exploded perspective view showing the construction of the transformable toy.

As shown in FIGS. 2 and 3, the transformable toy A includes a transformation activating body 1, which is formed to imitate a hood of a vehicle, a toy main body 2, which is formed to imitate a body of a vehicle, and a restricting mechanism B, which restricts the change from the form of the running toy which is the first form to the form of the robot which is the second form.

A latch releasing member 5, which constitutes the restricting mechanism B, is coupled with the transformation activating body 1. The latch releasing member 5 is pivotally coupled with the transformation activating body 1 by a shaft 7, which is inserted through a shaft hole 10 formed in a rear portion of the transformation activating body 1 and a shaft hole 6 formed in a front portion of the latch releasing member 5. The transformation activating body 1 is biased by a spring 8 so as to turn around the shaft 7 upward relative to the latch releasing member 5.

The latch releasing member 5 is received in an opening 29 formed in a front portion of a cover member 15 described below so as to slide back and forth. The latch releasing member 5 has an oblong hole 9 formed therein along a front-back direction. An engaging shaft 17 of the cover member 15 is engaged with the oblong hole 9 and the engaging shaft 17 is biased by a spring 13 so as to be pressed against the rear end of the oblong hole 9 (see FIG. 4), so that the latch releasing member 5 is arranged so as to be constantly urged to slide forward together with the transformation activating body 1 relative to the engaging shaft 17, i.e. relative to the cover member 15.

The latch releasing member 5 has a hook 11 formed on a rear portion thereof. The hook 11 of the latch releasing member 5 is also always biased by the above described spring 13 so as to be disengageably engaged with an engaging projection 46 that is formed on a later-described base body 3 and that constitutes the restricting mechanism B.

The transformation activating body (hereinafter, also referred to as a hood portion) 1 is provided thereon with a hook 12, which is engageable with a hook 31 of a latching member 30 fixed in the interior of a later-described head portion 23 (see FIGS. 4 and 5). When the hook 12 of the hood portion 1 and the hook 31 of the latching member 30 are engaged with each other, turning of the hood portion 1 about the shaft 7 is prevented, so that the hood portion 1 constitutes a hood of the running toy in the first form.

The toy main body 2 is mainly composed of: the cover member 15, which is formed to imitate a cab of a vehicle; a pair of side covers 18, to which rear wheels 19 are attached; a body portion 24, which is integrally formed with the head portion 23 of a robot toy; and the base body 3. The cover member 15 is provided with a pair of shaft bodies 16 which are projected downward from a front portion thereof. A pair of arms 25 are respectively attached to the pair of shaft bodies 16 so as to turnably support the side covers 18. The distal ends of the shaft bodies 16 are fitted in respective fitting portions 27 formed in opposite sides of the body portion 24 and are fixed to the body portion 24 by screws (not shown) from below. Each of the arms 25 is turnably attached to the shaft 16 while the arm 25 is biased by a spring 28 so as to turn outward about the shaft 16.

The engaging shaft 17 is formed at the inner side of the cover member 15 so as to project downward (see FIG. 4), and the engaging shaft 17 is engaged with the oblong hole 9 of the latch releasing member 5 as described above. The cover member 15 includes a supporting plate 36 formed on the lower surface of a rear portion thereof, which plate has a shaft hole 37 formed at a distal end thereof and which is pivotally coupled with the base body 3 in a manner described later.

Each of the side covers 18 has a fitting recess 20 formed at the distal end thereof to turnably fit around a spherical fitting portion 26 formed at the distal end of the arm 25. Each of the side covers 18 has an engaging portion 21 formed on an inner wall surface of a rear portion thereof so as to disengageably engage with a hook 47 that is formed at a rear end of the base body 3 to project outward. When the transformable toy A is in the first form, the engaging portions 21 of the side covers 18 are engaged with the respective hooks 47 of the base body 3, so that each of the side covers 18 cannot be separated from the base body 3. On the other hand, at the time of the transformable toy A being transformed from the first form to the second form, when the cover member 15 and the body portion 24 of the toy main body 2 turn upward, the engaging portions 21 of the side covers 18 are disengaged from the hooks 47 to permit the arms 25 to turn laterally outward about the shaft bodies 16 due to being biased by the springs 28. Consequently, the side covers 18 attached to the distal ends of the arms 25 are also turned outward and separated from the base body 3, thereby constituting arm portions of the robot toy which is the second form.

A latching member 30 having the hook 31 formed thereon is disposed in the head portion 23 and fixed therein by a screw 32, so that the latching member 30 and the body portion 24 are integrated with each other. The hook 31 is configured to be disengageably engaged with the hook 12 provided in the transformation activating body 1 (see FIGS. 4 and 5). When the engagement of the hooks 12 and 31 is released, the transformation activating body 1 is turned upward about the shaft 7 due to it being biased by the spring 8, whereby the head portion 23 is exposed.

Figure 4:
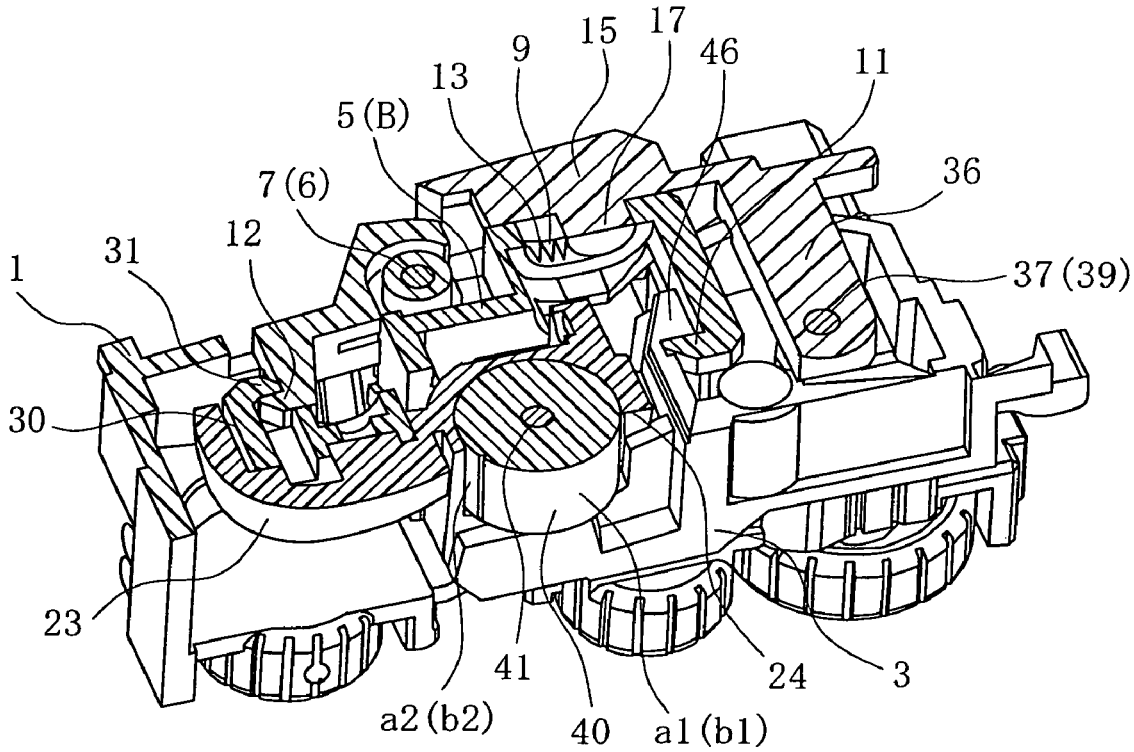
FIG. 4 is a perspective view of a vertical cross section showing the first form of the transformable toy.

A drum-shaped display body 40 is received in the body portion 24 and rotatably retained by a shaft 41 (see FIG. 4). The circumferential surface of the display body 40 is divided into a plurality of areas, for example three areas a1 to a3 as in the illustrated embodiment, in the circumferential direction, so that each of the areas a1 to a3 has visual information b (pieces of visual information b1 to b3), which is identified by being painted different colors (for example, red, green, and yellow). The visual information b is not limited to being painted different colors; instead, it may be different designs (for example, pictures of a rock, paper, scissors). The visual information b can serve as a condition for determining the result of playing a game by comparing one piece of visual information visible on the display body 40 of a user's transformable toy A with that visible on the display body of an opponent's transformable toy.

An engaging plate 42 having an approximately-polygonal shape, i.e., an approximately triangular shape in the illustrated embodiment, which has a number of sides corresponding to the number of the plurality of areas having the respective pieces of visual information b, is formed on one side surface of the display body 40 so as to protrude therefrom. When the body portion 24 turns upward integrally with the display body 40 to an upright state upon upward turning of the cover member 15 and the body portion 24 of the toy main body 2, the engaging plate 42 is engaged with an engaging projection 48, which is formed on an upper surface of the base body 3 to project therefrom, thereby the display body 40 is prevented from rotating and one of the areas a1 to a3 is specified, so that the visual information b (one of the pieces of visual information b1 to b3) displayed in the specified area can be seen from the front (see FIGS. 5 and 6).

The base body 3 is formed of first and second base body parts 3*a* and 3*b*, which are formed to imitate left and right leg portions of the robot toy in the second form and are united with each other by fixing them by a screw 35. The hook 11 formed on the latch releasing member 5 and the supporting plate 36 formed on the cover member 15 are inserted in the base body 3 from above. A supporting shaft 39, which is inserted through shaft holes 38 formed in the base body 3, is inserted through the shaft hole 37 formed at the distal end of the supporting plate 36, so that the cover member 15 and the body portion 24 can be turned upward about the supporting shaft 39 due to it being biased by a spring 45. The engaging projection 46 that constitutes the restricting mechanism B is formed on the inner wall surface of the base body 3. When the hook 11 of the latch releasing member 5 is engaged with the engaging projection 46, the upward turning of the cover member 15 and the body portion 24 of the toy main body 2 is inhibited.

The engaging projection 48 is formed at the upper end of the first base body part 3*a* so as to project upward therefrom. The engaging projecting 48 is disengageably engaged with the peripheral surface of the engaging plate 42 of the display body 40 in the second form in order to prevent turning of the display body 40.

The hooks 47 are formed at the rear ends of the first and second base body parts 3*a* and 3*b* to extend toward outside. In the form of the running toy which is the first form, the hooks 47 are engaged with the respective engaging portions 21 of the side covers 18, so that the side surfaces of the base body 3 are covered by the side covers 18, respectively, and the rear wheels 19 of the running toy work.

Figure 5:
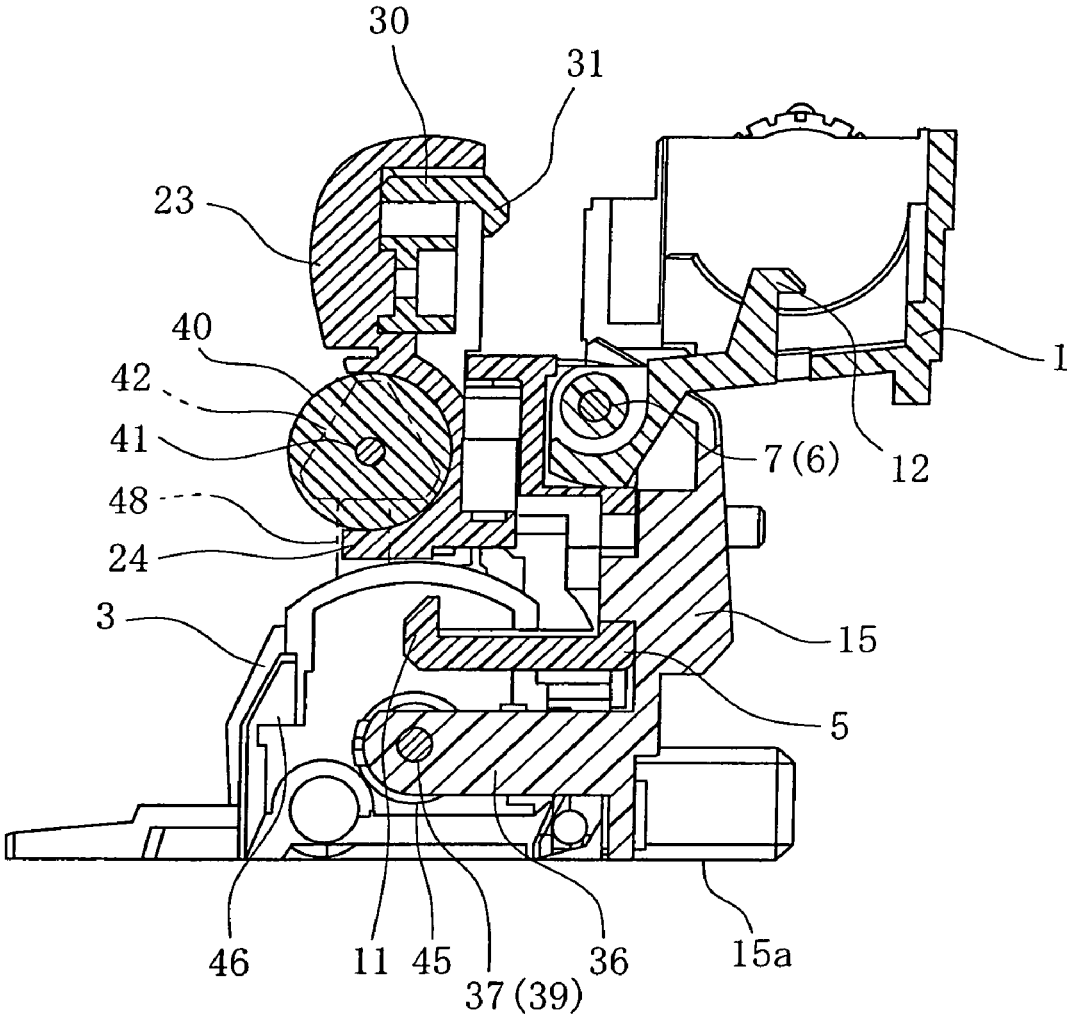
FIG. 5 is a vertical cross sectional view showing the second form of the transformable toy.
Figure 6:
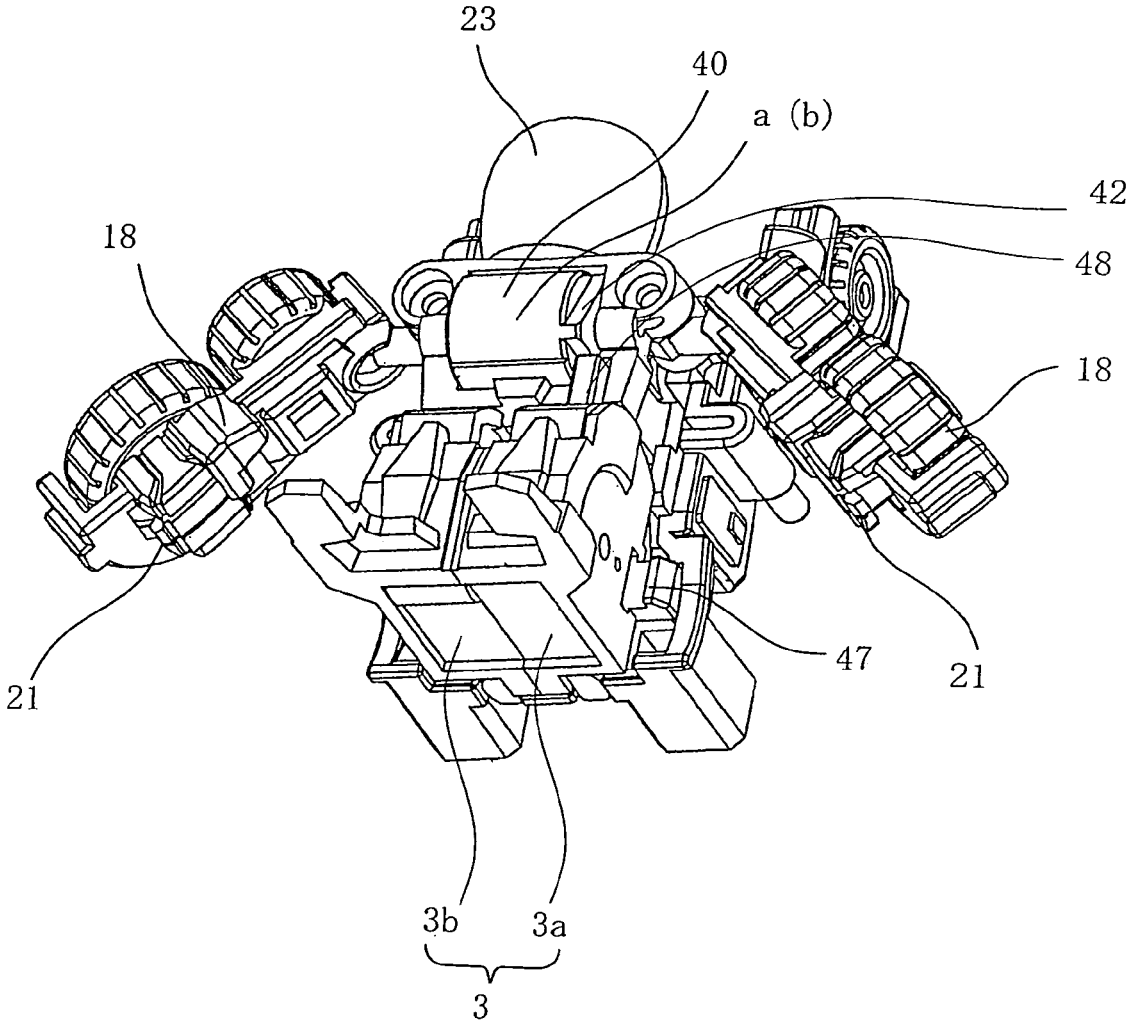
FIG. 6 is a bottom-side perspective view showing the second form of the transformable toy.

The cover member 15 is configured so that, when the hook 11 formed on the latch releasing member 5 is engaged with the engaging projection 46 formed on the inner wall surface of the base body 3, the upward turning of the cover member 15 against the biasing force of the spring 45 is prevented, so that the cover member 15 constitutes the cab in the form of the running toy; whereas, when the hood portion 1 moves backward relative to the base body 3, the engagement of the hook 11 of the latch releasing member 5 and the engaging projection 46 of the base body 3 is released and the cover member 15 is turned upward about the supporting shaft 39 due to it being biased by the spring 45, resulting in that the cover member 15 turns until a rear surface 15*a* thereof abuts a supporting surface that the transformable toy A is placed on and becomes in the upright state, as shown in FIG. 5. When the cover member 15 turns upward, the hood portion 1 and the body portion 24 also turn upward integrally with the cover member 15.

When the body portion 24 turns upward integrally with the cover member 15, the display body 40 provided at the body portion 24 also turns upward together with the body portion 24. After the turning, the engaging plate 42 provided on the side surface of the display body 40 is located at the position where the engaging plate 42 is engaged with the engaging projection 48 of the base body 3. At this time, as shown in FIG. 5, one side of the engaging plate 42 is engaged with the distal end of the engaging projection 48 and prevents rotation of the display body 40, so that one piece of the visual information b (b1, b2, b3) of the display body 40 is displayed on the front surface.

Incidentally, the strength of the spring 45 may be increased so that the cover member 15 and the body portion 24 are moved beyond the upright state and the whole transformable toy A goes into a 360-degree roll or backflips.

Now, the manner of use of the transformable toy A will be explained.

Figure 7B:
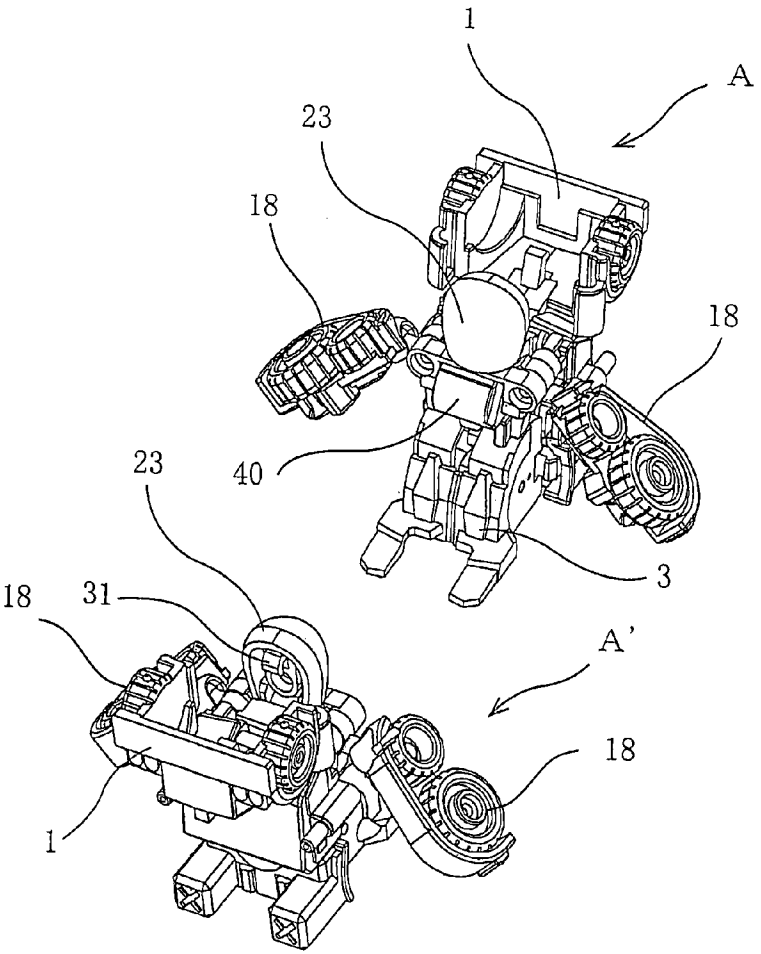
FIGS. 7A and 7B are perspective views showing a manner of use of the transformable toy.
Figure 7A:
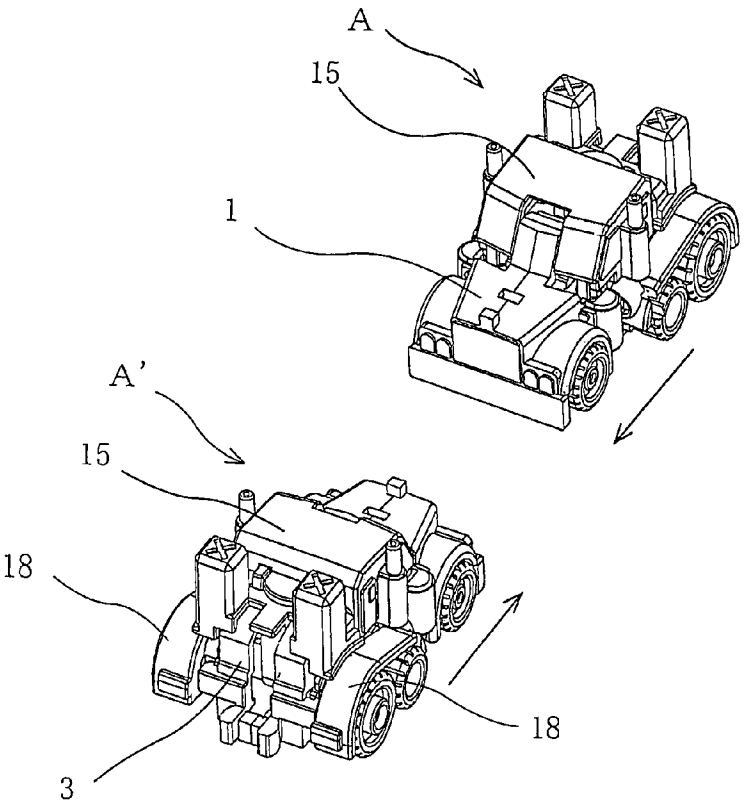

In the form of the running toy which is the first form, as shown in FIG. 7A, the transformable toy A and a transformable toy A' of an opponent are caused to move directly toward each other so as to hit each other. Since the transformable toys A and A' do not have a driving mechanism using a motor or a spring as a driving source, the toys can be caused to run by hand or caused to run by launching them with launching devices (not shown). The display bodies 40 are in contact with the supporting surface on which the transformable toys A and A' are running while the transformable toys A and A' are running, so that the display bodies 40 rotate in the state where the display bodies 40 are not visible to the users.

When the transformable toys A and A', which have been caused to run directly toward each other, hit each other, the forward movement of each of the transformable toys A and A' is prevented, so that the toy main body 2 is moved forward by the inertia relative to the hood portion 1 and thus the hood portion 1 is relatively moved backward. When the hood portion 1 is moved backward, the hook 11 of the latch releasing member 5, which constitutes the restricting mechanism B and is coupled with the hood portion 1, is disengaged from the engaging projection 46 of the base body 3, whereby the cover member 15 biased by the spring 45 turns upward together with the body portion 24 about the supporting shaft 39 relative to the base body 3; and the hook 31 of the latching member 30 provided on the head portion 23 is disengaged from the hook 12 of the hood portion 1, whereby the hood portion 1 biased by the spring 8 turns upward about the shaft 7 relative to the latch releasing member 5. As a result, the head portion 23 is exposed so as to be seen from the front. At this point, the display body 40 provided at the body portion 24 also becomes in the state where one piece of the visual information b (b1, b2 or b3) is positioned on the front surface to be seen by looking down upon it.

The distal end of each of the side covers 18 is pivotally supported by the shaft 16 of the cover member 15 via the arm 25, and each engaging portion 21 formed on the rear inner wall surface of the side cover 18 is engaged with the hook 47 that is formed at the rear end of the base body 3 so as to project outward therefrom. When the side covers 18 also turn upward integrally with the cover member 15, the engaging portions 21 of the side covers are each moved to such a position that the engaging portions 21 are disengaged from the respective hooks 47 of the base body 3. Therefore, the arms 25 biased by the springs 28 rotate outward about the respective shaft bodies 16 of the cover member 15 and the side covers 18 coupled with the arms 25 also rotate laterally outward so as to constitute the arm portions of the robot toy which is the second form, resulting in that the transformable toy A is transformed into the robot toy which is the second form in the upright state with both the arms open to the outside.

At this point, one side of the engaging plate 42 of the display body 40 is engaged with the distal end of the engaging projection 48 of the base body 3 to thereby prevent rotation of the display body 40, and the state in which one piece of the visual information b (b1, b2 or b3) can be seen from the front is achieved.

When the two transformable toys A and A' are put in a match against each other and are each transformed into the robot toy which is the second form, the visual information b of the display bodies 40 of both of the toys made visible can be checked and compared. Therefore, a win/loss judgment (for example, if the visible visual information of one of the transformable toys is green and that of the other transformable toy is a color other than green, the one transformable toy displaying the green is determined to be the winner; and, if the colors thereof are the same, the match ends in a draw) can be made. Accordingly, the transformable toy having a game element which is not only capable of changing the form thereof but also capable of utilizing the visual information which appears for making a win/loss judgment can be realized.

In the transformable toy described above, the hitting, which is dynamic, is used as a physical stimulation for releasing the restriction by the restricting mechanism. However, the physical stimulation for releasing the restriction is not necessarily limited to such a dynamic one, and instead, for example, the restriction may be released by a known technique of sensing static stimulation such as infrared rays or magnetic force by a sensor and driving a solenoid.

What is claimed is:

1. A transformable toy reversibly transformed between a first form and a second form, comprising:

a toy main body which changes a form to form the first form and the second form;

a restricting mechanism which restricts the form change of the toy main body from the first form to the second form; and a transformation activating body for detecting physical stimulation from outside and releasing the restriction by the restricting mechanism;

wherein the toy main body includes a display body having visual information thereon, and the display body is disposed at such a position that the visual information of the display body is invisible to a user in the first form while the visual information of the display body is visible to the user in the second form, wherein the display body is formed to have a drum shape and has a plurality of pieces of the visual information provided on a circumferential surface thereof along a circumferential direction, and wherein the display body is disposed in the toy main body so that, in the first form, the display body is rotatable in a front-back direction while the circumferential surface of the display body is in contact with a supporting surface, on which the transformable toy is placed, and so that, in the second form, one of the plurality of pieces of the visual information on the circumferential surface of the display body is visible.

2. The transformable toy according to claim 1, wherein the transformation activating body is supported to slide back and forth by the toy main body in the first form;

the toy main body includes a body portion for supporting the transformation activating body and a base body for supporting the body portion to be turnable in a vertical direction, and when the body portion is turned downward, the toy main body forms the first form of the transformable toy;

when the transformation activating body slides backward, the restriction by the restricting mechanism is released, the body portion turns upward relative to the base body and becomes in an upright state with respect to the base body, so that the toy main body forms the second form of the transformable toy; and when the body portion turns upward, the display body is positioned in a front surface of the toy main body which can be seen by looking down upon it.

3. The transformable toy according to claim 2, wherein the base body includes an engaging portion that is disengageably engaged with the display body to prevent rotation of the display body in the second form, so that when the engaging portion of the base body is engaged with the display body, the one piece of visual information is made visible.

4. The transformable toy according to claim 3, wherein the circumferential surface of the display body is divided into a plurality of areas in the circumferential direction, each of the areas having a respective one of the plurality pieces of visual information; and the display body includes a polygonal engaging plate that has a number of sides corresponding to the number of the plurality of areas and that is provided on a side surface of the display body, so that the engaging portion of the base body is engaged with one of the sides of the engaging plate to prevent rotation of the display body and specify the one piece of visual information to be made visible.

5. The transformable toy according to claim 2, wherein the restricting mechanism includes an engaging projection formed on the base body, a latch releasing member on which a hook engageable with the engaging projection of the base body is formed and which is coupled with the transformation activating body, and a spring for biasing the latch releasing member to engage the hook of the latch releasing member with the engaging projection of the base body; and when the transformation activating body slides backward, the hook of the latch releasing member is disengaged from the engaging projection of the base body so as to release the restriction by the restricting mechanism.

6. The transformable toy according to claim 5, wherein the transformable toy is a running toy in the first form and is a robot toy in the second form;

the transformation activating body and the toy main body form a hood and a body of the running toy, respectively, in the first form;

the latch releasing member and the transformation activating body are coupled with each other and biased by another spring so that the transformation activating body turns upward relative to the latch releasing member;

the body portion includes a head portion formed thereon, the head portion having a latching member engageable with the transformation activating body;

in the first form, the latching member is engaged with the transformation activating body, the head portion being positioned in the transformation activating body; and when the transformation activating body is disengaged from the latching member of the head portion, the transformation activating body turns upward due to it being biased by the other spring, so that the head portion is exposed to constitute a head of the robot toy in the second form.

7. The transformable toy according to claim 6, wherein the toy main body includes a cover member that constitutes a cab in the first form and a pair of side covers having rear wheels, each of the side covers being supported to be turnable in a lateral direction at a front end thereof by the cover member and being detachably fixed to the base body at a rear end thereof; and in the robot toy of the second form, the base body forms leg portions of the robot toy, and the pair of side covers constitute arm portions of the robot toy with the rear ends thereof being detached from the base body.

8. The transformable toy according to claim 2, wherein the transformable toy is a running toy in the first form and is a robot toy in the second form.

9. The transformable toy according to claim 1, wherein the base body includes an engaging portion that is disengageably engaged with the display body to prevent rotation of the display body in the second form, so that when the engaging portion of the base body is engaged with the display body, the one piece of visual information is made visible.

10. The transformable toy according to claim 9, wherein the circumferential surface of the display body is divided into a plurality of areas in the circumferential direction, each of the areas having a respective one of the plurality pieces of visual information; and the display body includes a polygonal engaging plate that has a number of sides corresponding to the number of the plurality of areas and that is provided on a side surface of the display body, so that the engaging portion of the base body is engaged with one of the sides of the engaging plate to prevent rotation of the display body and specify the one piece of visual information to be made visible.

11. The transformable toy according to claim 1, wherein the transformable toy is a running toy in the first form and is a robot toy in the second form.

12. The transformable toy according to claim 1, wherein the visual information is selected from colors and pictures.

13. The transformer toy according to claim 1, further comprising a second one of the toy and, when the two toys contact each other while in the first form, the restricting mechanism is released and each toy moves into the second form.

14. The transformer toy according to claim 13, wherein the visible indicia of the respective toys are compared in the game playing.

15. The transformer toy according to claim 1, wherein the toy moves from the first form to the second form in response to a remote signal detected by the toy.

16. A toy movable between a first form and a second form, comprising:

a toy main body which moves between the first form and the second form;

a restricting mechanism which selectively restricts the toy main body from moving between the first form and the second form; and a transformation activating body for releasing the restriction by the restricting mechanism;

wherein the toy main body includes a display body having game playing indicia formed thereon, and being disposed so that the indicia is invisible to a user of the toy in the first form but visible to the user in the second form, wherein the display body has a drum shape and a plurality of the indicia on a circumferential surface thereof, and wherein the display body is rotatable and, in the second form, one of the plurality of the indicia is visible.

17. The toy according to claim 16, wherein the transformation activating body can move backward and forward in the first form;

the toy main body includes a body portion for supporting the transformation activating body and a base body for supporting the body portion to be movable in a first direction and a second direction, and when the body portion is moved in the first direction, the toy main body forms the first form of the toy;

when the transformation activating body moves backward, the restriction by the restricting mechanism is released, and the body portion moves in the second direction, so that the toy main body forms the second form of the toy; and when the body portion moves in the second direction, the display body is visible.

18. The toy according to claim 17, wherein the base body includes an engaging portion that is disengageably engaged with the display body to prevent rotation of the display body in the second form, so that when the engaging portion of the base body is engaged with the display body, said one of the plurality of the indicia is visible.

19. The toy according to claim 18, wherein the circumferential surface of the display body is divided into a plurality of areas, each of the areas having a respective said one of the plurality of the indicia; and the display body includes an engaging plate that has a number of sides corresponding to the number of the plurality of areas and that is provided on a side surface of the display body, so that the engaging portion of the base body is engaged with one of the sides of the engaging plate to prevent rotation of the display body and specify said one of the plurality of the indicia to be made visible.

20. The toy according to claim 17, wherein the restricting mechanism includes an engaging projection formed on the base body, a latch releasing member on which a hook engageable with the engaging projection of the base body is formed and which is coupled with the transformation activating body, and a first spring for biasing the latch releasing member to engage the hook of the latch releasing member with the engaging projection of the base body; and when the transformation activating body moves backward, the hook of the latch releasing member is disengaged from the engaging projection of the base body so as to release the restriction by the restricting mechanism.

21. The toy according to claim 20, wherein the toy is a running toy in the first form and is a robot toy in the second form;

the transformation activating body and the toy main body form a hood and a body of the running toy, respectively, in the first form;

the latch releasing member and the transformation activating body are coupled with each other and a second spring biases the transformation activating body relative to the latch releasing member;

the body portion includes a head portion having a latching member engageable with the transformation activating body;

in the first form, the latching member is engaged with the transformation activating body, the head portion being positioned in the transformation activating body; and when the transformation activating body is disengaged from the latching member of the head portion, the transformation activating body moves in the second direction due to being biased by the second spring, so that the head portion is exposed to constitute a head of the robot toy in the second form.

22. The transformable toy according to claim 21, wherein the toy main body includes a cover member that constitutes a cab in the first form and a pair of side covers having rear wheels, each of the side covers being supported to be movable by the cover member and being detachably fixed to the base body at one end thereof; and in the robot toy of the second form, the base body forms leg portions of the robot toy, and the pair of side covers constitutes arm portions of the robot toy with ends thereof being detached from the base body.

23. The toy according to claim 17, wherein the toy is a running toy in the first form and is a robot toy in the second form.

24. The toy according to claim 16, wherein the base body includes an engaging portion that is disengageably engaged with the display body to prevent rotation of the display body in the second form, so that when the engaging portion of the base body is engaged with the display body, said one of the plurality of the indicia is visible.

25. The toy according to claim 24, wherein the circumferential surface of the display body is divided into a plurality of areas, each of the areas having a respective said one of the plurality of the indicia; and the display body includes an engaging plate that has a number of sides corresponding to the number of the plurality of areas and that is provided on a side surface of the display body, so that the engaging portion of the base body is engaged with one of the sides of the engaging plate to prevent rotation of the display body and specify said one of the plurality of the indicia to be made visible.

26. The toy according to claim 16, wherein the toy is a running toy in the first form and is a robot toy in the second form.

27. The toy according to claim 16, wherein the indicia is selected from colors and pictures.

28. The toy according to claim 16, further comprising a second one of the toy and, when the two toys contact each other while in the first form, the restricting mechanism is released and each toy moves into the second form.

29. The toy according to claim 28, wherein the visible indicia of the respective toys are compared in the game playing.

30. The toy according to claim 16, wherein the toy moves from the first form to the second form in response to a remote signal detected by the toy.

31. A toy movable between a first form and a second form, comprising:

a toy main body which moves between the first form and the second form;

a restricting mechanism which selectively restricts the toy main body from moving between the first form and the second form; and a transformation activating body for releasing the restriction by the restricting mechanism;

wherein the toy main body includes a display body having game playing indicia formed thereon, and being disposed so that the indicia is invisible to a user of the toy in the first form but visible to the user in the second form, wherein the transformation activating body can move backward and forward in the first form, wherein the toy main body includes a body portion for supporting the transformation activating body and a base body for supporting the body portion to be movable in a first direction and a second direction, and when the body portion is moved in the first direction, the toy main body forms the first form of the toy, when the transformation activating body moves backward, the restriction by the restricting mechanism is released, and the body portion moves in the second direction, so that the toy main body forms the second form of the toy and, when the body portion moves in the second direction, the display body is visible, wherein the display body has a drum shape and a plurality of the indicia thereon; and the display body is rotatable, and, in the second form, one of the plurality of the indicia is visible.

32. The toy according to claim 31, wherein the indicia is selected from colors and pictures.

33. The toy according to claim 31, further comprising a second one of the toy and, when the two toys contact each other while in the first form, the restricting mechanism is released and each toy moves into the second form.

34. The toy according to claim 33, wherein the visible indicia of the respective toys are compared in the game playing.

35. The toy according to claim 31, wherein the toy moves from the first form to the second form in response to a remote signal detected by the toy.

* * * * *

UNITED STATES PATENT AND TRADEMARK OFFICE

CERTIFICATE OF CORRECTION

PATENT NO. : 8,348,715 B2
APPLICATION NO. : 12/801375
DATED : January 8, 2013
INVENTOR(S) : Tomoya Miyake It is certified that error appears in the above-identified patent and that said Letters Patent is hereby corrected as shown below:

Title Page Col. 1, Item (30) (Foreign Application Priority Data); Line 1, Delete "Nov. 12, 2009" and insert -- Dec. 11, 2009 --, therefor.

Signed and Sealed this
Seventh Day of May, 2013

Teresa Stanek Rea
*Acting Director of the United States Patent and Trademark Office*